US006973796B2

(12) United States Patent
Park et al.

(10) Patent No.: US 6,973,796 B2
(45) **Date of Patent: *Dec. 13, 2005**

(54) MULTI-AIR CONDITIONER AND OPERATION METHOD THEREOF

(75) Inventors: Jong Han Park, Gwangmyeong-si (KR); Young Min Park, Incheon-si (JP); Chang Seon Lee, Seoul (KR); Sung Oh Choi, Gwangmyeong-si (KR); Sung Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/641,143

(22) Filed: Aug. 15, 2003

(65) Prior Publication Data

US 2004/0035132 A1 Feb. 26, 2004

(30) Foreign Application Priority Data

Aug. 22, 2002 (KR) ..... 10-2002-0049752

(51) Int. Cl.[7] ..... F25B 13/00; F25B 41/00; F25B 49/00

(52) U.S. Cl. ..... 62/160; 62/324.1; 62/196.1

(58) Field of Search ..... 62/324.6, 504, 62/510, 335, 498, 513, 160, 196.1

(56) References Cited

U.S. PATENT DOCUMENTS

| | | | | |
|---|---|---|---|---|
| 4,562,700 | A | 1/1986 | Atsumi et al. | |
| 4,987,747 | A | 1/1991 | Nakamura et al. | |
| 5,009,077 | A | 4/1991 | Okoshi et al. | |
| 5,050,396 | A | 9/1991 | Ohkoshi et al. | |
| 5,142,879 | A | 9/1992 | Nakamura et al. | |
| 5,237,833 | A | 8/1993 | Hayashida et al. | |
| 5,309,733 | A * | 5/1994 | Hayashida et al. | 62/278 |
| 5,347,826 | A | 9/1994 | Hayashida et al. | |
| 5,388,422 | A | 2/1995 | Hayashida et al. | |
| 5,568,732 | A | 10/1996 | Isshiki et al. | |
| 5,848,537 | A | 12/1998 | Biancardi et al. | |
| 5,927,087 | A | 7/1999 | Ishikawa et al. | |
| 5,996,368 | A | 12/1999 | Kim | |
| 2003/0230100 | A1 | 12/2003 | Hwang | |
| 2004/0035133 | A1 * | 2/2004 | Park et al. | 62/324.1 |
| 2004/0035135 | A1 * | 2/2004 | Park et al. | 62/324.6 |

FOREIGN PATENT DOCUMENTS

| | | | |
|---|---|---|---|
| EP | 0496505 | 7/1992 | |
| EP | 0509619 | 10/1992 | |
| EP | 0575063 | 12/1993 | |
| EP | 1371912 | 12/2003 | |
| JP | 2-106667 | 4/1990 | |
| JP | 03011276 A * | 1/1991 | F25B/29/00 |

OTHER PUBLICATIONS

English Language Abstract of JP 2–106667.

* cited by examiner

*Primary Examiner*—Chen Wen Jiang
(74) *Attorney, Agent, or Firm*—Greenblum & Bernstein, P.L.C.

(57) ABSTRACT

Disclosed is a multi-air conditioner including: an outdoor unit having a compressor, an outdoor heat exchanger, and an outdoor fan for ventilating the outdoor heat exchanger; a plurality of indoor units each having an electronic expansion valve and an indoor heat exchanger; a distributor for selectively guiding a refrigerant of the outdoor unit into the plurality of indoor units according to an operation condition; a four-way valve for selectively switching a flow direction of the refrigerant flowing through the outdoor heat exchanger; a selective expansion unit for selectively expanding the refrigerant according to the flow direction of the refrigerant; a gas-liquid separator for separating a vapor-phase refrigerant and a liquid-phase refrigerant, from the refrigerant flowing from the outdoor heat exchanger; and a connection tube part having a first connection tube for connecting the four-way valve with a distributor, a second connection tube for connecting an upper portion of the gas-liquid separator with the distributor thereby guiding a vapor-phase refrigerant, and a third connection tube for connecting a lower portion of the gas-liquid separator with the distributor thereby guiding a liquid-phase refrigerant.

20 Claims, 5 Drawing Sheets

MULTI-AIR CONDITIONER AND OPERATION METHOD THEREOF

This application claims the benefit of the Korean Application No. P2002-0049752 filed on Aug. 22, 2002, which is hereby incorporated by reference.

BACKGROUND OF THE INVENTION

1. Field of the Invention

The present invention relates to a multi-air conditioner, and more particularly, to a multi-air conditioner and an operation method thereof capable of simultaneously performing cooling and heating operation.

2. Discussion of the Related Art

Generally, an air conditioner is an apparatus for cooling or heating an indoor space such as a residential space, office, restaurant and the like. Recently, a multi-air conditioner has been developed so as to more effectively cool or heat an inner space partitioned into a plurality of rooms.

The multi-air conditioner is comprised of one outdoor unit, and a plurality of indoor units each being connected to the outdoor unit and being installed every room. The multi-air conditioner operates in one of heating mode and cooling mode, thereby heating or cooling the room air.

However, the conventional multi-air conditioner has a drawback in that even when some rooms among the partitioned rooms need to be heated while other rooms need to be cooled, since all the indoor units are operated in heating mode or cooling mode, the conventional multi-air conditioner does not meet the request of the aforementioned multi-operations.

For example, in buildings, there may occur a temperature difference according to a directional position and a daylight time. That is, the northern rooms of a building need to be heated while the southern rooms need to be cooled owing to the sunlight. However, the conventional air conditioners have a limitation in meeting such requirements. Further, in case a building has a computer center, the building always needs to be cooled even in summer days as well as in winter days, so as to solve heat load generated from the computer equipments. However, the conventional air conditioner does not yet meet such selective air-conditioning requirements.

In order to solve these disadvantages, the multi-air conditioner is required to condition each room air individually at the same time. That is, it is requested that some room airs be heated in the heating mode and at the same time, other room airs be cooled in the cooling mode. Accordingly, it is required to develop a multi-air conditioner capable of selectively and simultaneously performing cooling and heating and having an economical structure for installation.

SUMMARY OF THE INVENTION

Accordingly, the present invention is directed to a multi-air conditioner and an operation method thereof that substantially obviate one or more problems due to limitations and disadvantages of the related art.

An object of the present invention is to provide a multi-air conditioner and an operation method thereof capable of simultaneously performing cooling and heating operations.

Another object of the present invention is to provide a multi-air conditioner including a miniaturized and light distributor.

A further another object of the present invention is to provide a multi-air conditioner and an operation method thereof, in which in case a plurality of indoor units all operate in a cooling mode or in case a majority of indoor units operate in the cooling mode while the rest of them operates in a heating mode, a mixed ratio of refrigerant introduced into a distributor is controlled to improve the air conditioning efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided multi-air conditioner including: an outdoor unit installed at an outdoor location, and having therein a compressor, an outdoor heat exchanger, and an outdoor fan for ventilating the outdoor heat exchanger; a plurality of indoor units installed at respective indoor rooms, each having therein an electronic expansion valve and an indoor heat exchanger; a distributor provided between the outdoor unit and the plurality of indoor units, for selectively guiding a refrigerant introduced from the outdoor unit to the plurality of indoor units according to an operation condition; a four-way valve provided on an outlet side of the compressor, for selectively switching a flow direction of the refrigerant flowing through the outdoor heat exchanger; a selective expansion unit provided at a rear side of the outdoor heat exchanger, for selectively expanding the refrigerant according to the flow direction of the refrigerant; a gas-liquid separator provided in the outdoor unit, for separating a vapor-phase refrigerant and a liquid-phase refrigerant from the refrigerant flowing out of the outdoor heat exchanger; and a connection tube part having a first connection tube for connecting the four-way valve with a distributor, a second connection tube for connecting an upper portion of the gas-liquid separator with the distributor to guide the vapor-phase refrigerant, and a third connection tube for connecting a lower portion of the gas-liquid separator with the distributor to guide the liquid-phase refrigerant.

Here, the four-way valve selectively switches between a first connection state in which the outlet side of the compressor is connected with the outdoor heat exchanger and an inlet side of the compressor is connected with the separator, and a second connection state in which the outlet side of the compressor is connected with the distributor and the inlet side of the compressor is connected with the outdoor heat exchanger.

Further, the selective expansion unit includes: a parallel tube connected between the outdoor heat exchanger and the gas-liquid separator; a first check valve provided on one side of the parallel tube, for passing the refrigerant flowing from the outdoor heat exchanger toward the gas-liquid separator; and a heating electronic expansion valve provided on the other side of the parallel tube, for expanding the refrigerant introduced into the outdoor heat exchanger.

In the meanwhile, the multi-air conditioner further including a bypass unit for guiding the refrigerant introduced through the second connection tube to the inlet of the compressor, in case a majority of indoor units operate in the heating mode while the rest operates in the cooling mode.

Here, the bypass unit includes: a bypass tube for connecting the vapor-phase tube with a tube connecting between the four-way tube and the outdoor heat exchanger; a first valve provided on the bypass tube, and opened only when the majority of indoor units operates in the cooling mode the rest operates in the heating mode; and a second check valve provided on the second connection tube positioned between the gas-liquid separator and the bypass tube, for passing only the refrigerant flowing from the gas-liquid separator toward the separator.

Furthermore, the distributor includes: a guide tube part for selectively guiding the refrigerant introduced from the outdoor unit to the respective indoor units, and guiding the refrigerant heat-exchanged in the respective indoor units to the outdoor unit; and a valve part for controlling a flow of the refrigerant in the guide tube part such that the refrigerant is selectively introduced into the respective indoor unit according to the operation condition.

Here, the guide tube part includes: vapor-phase branch tubes branched from the second connection tube and connected to the indoor units, respectively; liquid-phase branch tube branched from the third connection tube and connected to the indoor units, respectively; and connection branch tubes connecting the first connection tube and the indoor units, respectively.

Additionally, the valve part includes a two-way valve provided in each of the vapor-phase branch tubes, each of the liquid-phase branch tubes, and each of the connection branch tubes, and turned on or off according to the operation condition.

Also, each electronic expansion valve provided in each of the indoor units is provided in each of the liquid-phase branch tubes connecting the indoor heat exchangers and the distributor.

Meanwhile, the multi-air conditioner preferably further includes control means for controlling revolution times of the outdoor fan such that a mixed ratio of a vapor-phase refrigerant and a liquid-phase refrigerant introduced to the gas-liquid separator via the outdoor heat exchanger is controlled according to the operation condition.

Here, the control means includes: a temperature sensor provided between the outdoor heat exchanger and the gas-liquid separator, for sensing a temperature of the refrigerant; and a microcomputer for comparing the sensed temperature of the refrigerant with a predetermined temperature to calculate the mixed ratio of the refrigerant, and for controlling the revolution times of the outdoor fan to equalize the calculated mixed ratio with the predetermined mixed ratio according to the operation condition, in case the indoor units all operate in the cooling mode, or in case a majority of indoor units operate in the cooling mode while the rest operates in the heating mode.

In the multi-air conditioner, in case the indoor units all operate in the cooling mode or in case the majority of indoor units operate in the cooling mode while the rest operates in the heating mode, the four-way valve is switched to connect the outlet of the compressor with the outdoor heat exchanger and to connect the inlet of the compressor with the distributor.

Here, in case the indoor units all operate in the cooling mode, the heating electronic expansion valve and the first valve are closed, the electronic expansion valves of the indoor units all operate, the two-way valves connected to the vapor-phase branch tubes are all closed, and the two-way valves connected to the connection branch tubes and the liquid-phase branch tubes are all opened.

Additionally, in case the majority of indoor units operate in the cooling mode while the rest operates in the heating mode, the heating electronic expansion valves and the first valve are closed, in case of the indoor units operating in the cooling mode, the electronic expansion valves connected to the indoor heat exchangers operate, the two-way valves connected to the vapor-phase branch tubes are closed, and the two-way valves connected to the connection branch tubes and the liquid-phase branch tubes are opened, and in case of the indoor units operating in the heating mode, the electronic expansion valves connected to the indoor heat exchangers are opened, and the two-way valves connected to the vapor-phase branch tubes, the liquid-phase branch tubes and the connection branch tubes are opened.

Meanwhile, in case the indoor units all operate in the heating mode, or in case the majority of indoor units operate in the heating mode while the rest operates in the cooling mode, the four-way valves are switched to connect the outlet of the compressor with the distributor and to connect the inlet of the compressor with the outdoor heat exchanger.

Here, in case the indoor units all operate in the heating mode, the heating electronic expansion valves operate, the first valve is closed, the electronic expansion valves of the indoor units are all opened, the two-way valves connected to the vapor-phase branch tubes are all closed, and the two-way valves connected to the connection branch tubes and the liquid-phase branch tubes are all opened.

Further, in case the majority of indoor units operate in the heating mode while the rest operates in the cooling mode, the heating electronic expansion valve operates and the first valve is closed, in case of the indoor units operating in the heating mode, the electronic expansion valves connected to the indoor heat exchangers are opened, the two-way valves connected to the vapor-phase branch tubes are closed, and the two-way valves connected to the connection branch tubes and the liquid-phase branch tubes are opened, and in case of the indoor units operating in the cooling mode, the electronic expansion valves connected to the indoor heat exchangers operate, the two-way valves connected to the vapor-phase branch tube and the liquid-phase branch tube are closed, and the two-way valves connected to the connection branch tube are opened.

Furthermore, the gas-liquid separator is provided between the selective expansion unit and the distributor.

In another aspect of the present invention, there is provided an operation method of a multi-air conditioner. The method includes the steps of: in case indoor units all operate in a cooling mode, or in case a majority of indoor units operate in the cooling mode while the rest operates in a heating mode, switching a four-way valve such that a refrigerant discharged from a compressor is introduced into an outdoor heat exchanger; and closing a heating electronic expansion valve, and in case the indoor units all operate in the heating mode, or in case the majority of indoor units operate in the heating mode while the rest operates in the cooling mode, switching the four-way valve such that a vapor-phase refrigerant discharged from the compressor is introduced into a first connection tube; and operating the heating electronic expansion valve.

In a further another aspect of the present invention, there is provided an operation method of a multi-air conditioner. The method includes the steps of: in case indoor units all operate in a cooling mode, or in case a majority of indoor units operate in the cooling mode while the rest operates in a heating mode, sensing a temperature of a refrigerant using a temperature sensor; and comparing the sensed temperature of the refrigerant with a predetermined temperature to detect a mixed ratio of the refrigerant in a tube; and varying revolution times of an outdoor fan to equalize the detected mixed ratio with a predetermined mixed ratio.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
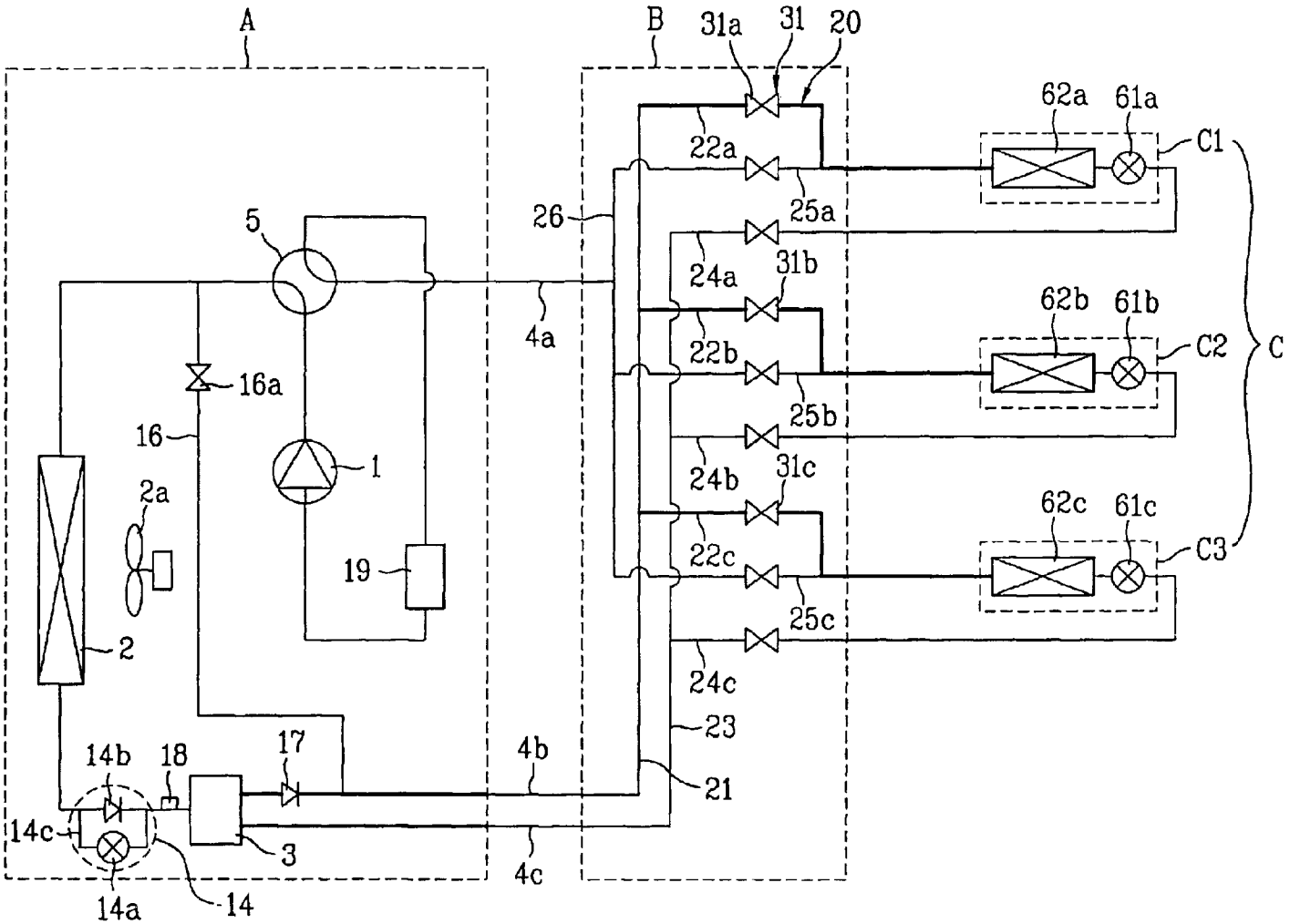
FIG. 1 is a construction view of a multi-air conditioner according to a preferred embodiment of the present invention.

FIG. 1 is a construction view of illustrating structural elements of a multi-air conditioner according to a preferred embodiment of the present invention.

Herein, it is noted that a reference numeral 22 indicates "22*a*, 22*b* and 22*c*", 24 indicates "24*a*, 24*b* and 24*c*", 25 indicates "25*a*, 25*b* and 25*c*", 31 indicates "31*a*, 31*b* and 31*c*", 61 indicates "61*a*, 61*b* and 61*c*", and 62 indicates "62*a*, 62*b* and 62*c*", for description convenience. However, it will be understood that the numbers of the reference numerals can be changed depending on the numbers of indoor units.

As shown in FIG. 1, a multi-air conditioner includes an outdoor unit (A), a distributor (B), and a plurality of indoor units (C1, C2 and C3). The outdoor unit (A) includes a compressor 1, an outdoor heat exchanger 2, a selective expansion unit 14, and a gas-liquid separator 3 and the like. The distributor (B) includes a guide tube part 20 and a valve part 31. Also, each of the plurality of indoor units (C) includes an indoor heat exchanger 62 and an electronic expansion unit 61.

Generally, the outdoor unit (A) is installed on an outdoor wall or the bottom of a roof, and the distributor (B) is installed at an indoor ceiling or an indoor marginal space. Accordingly, it is difficult to install the distributor (B) in the indoor space as the distributor (B) increases in weight or volume.

Specifically, in case the distributor (B) increases in the weight, the distributor (B) may fall down due to increase of a falling load when it is installed at the indoor ceiling.

Accordingly, it is desirable that only guide tube parts 20 for guiding the supply of refrigerant are installed in the distributor (B), while the rest such as a gas-liquid separator 3 is installed in the outdoor unit (A), not in the distributor (B). At the same time, it is desirable for a low product price that a tube structure of the outdoor unit (A) is simplified to improve an efficiency of the multi-air conditioner and to simplify a fabrication process thereof.

First, a construction of the outdoor unit (A) will be described as follows.

Referring to FIG. 1, the outdoor unit (A) includes the compressor 1, the outdoor heat exchanger 2, an outdoor fan 2*a*, the gas-liquid separator 3, a four-way valve 5, the selective expansion unit 14, and tubes for connecting the aforementioned elements to one another.

Herein, the gas-liquid separator 3 separates a vapor-phase refrigerant and a liquid-phase refrigerant from the refrigerant discharged from the outdoor heat exchanger 2, to discharge the separated refrigerants into the distributor (B), respectively. For this, an upper portion of the gas-liquid separator 3 is connected to a second connection tube 4*b* for guiding the vapor-phase refrigerant. Also, a lower portion of the gas-liquid separator 3 is connected to a third connection tube 4*c* for guiding the liquid-phase refrigerant.

Further, as described above, the gas-liquid separator 3 is provided in the outdoor unit (A), not in the distributor (B), and more specifically, is provided between the selective expansion unit 14 and the distributor (B).

On the other hand, as shown in FIG. 1, the selective expansion unit 14 is provided at a rear side of the outdoor heat exchanger 2. The selective expansion unit 14 is comprised of a parallel tube 14*c*, *a* first check valve 14*b*, and a heating electronic expansion valve 14*a*.

Herein, the parallel tube 14*c* is provided between the outdoor heat exchanger 2 and the gas-liquid separator 3. The first check valve 14*b* is provided in one side of the parallel tube 14*c* to pass only refrigerant flowing from the outdoor heat exchanger 2 into the gas-liquid separator 3. The heating electronic expansion valve 14*a* is provided in the other side of the parallel tube 14*c* and controlled depending on an operation condition, to expand only refrigerant introduced into the outdoor heat exchanger 2.

Electronic expansion valves according to the present invention can be selectively switched to be in an operation state, in a closed state, or in an opened state. In the operation state, the electronic expansion valve allows the passing refrigerant to expand.

Through the above construction, the selective expansion unit 14 selectively expands only refrigerant introduced into the outdoor heat exchanger 2.

Meanwhile, the four-way valve 5 includes two inlets and two outlets. The inlets are respectively communicated with the outlets to form two flow channels total. And, a communication state between the inlets and the outlets is varied by a switching signal, etc. Accordingly, the four-way valve 5 is used for selectively varying a flow direction of the refrigerant flowing therethrough. For this, the four-way valve 5 is preferably provided in an adjacent position to a discharging outlet of the compressor 1.

Herein, the four-way valve 5 functions to vary the flow direction of the refrigerant flowing through the outdoor heat exchanger 2 in relation to the compressor 1 and the outdoor heat exchanger 2.

Generally, in a thermodynamic cycle for heating and cooling, the refrigerant is circulated in a sequence of the compressor-→condenser-→expansion valve-→evaporator. That is, the heat exchanger connected to the refrigerant discharging outlet of the compressor 1 functions as the condenser, and the heat exchanger connected to the refrigerant absorbing inlet of the compressor 1 functions as the evaporator.

Accordingly, if the four-way valve 5 is used for varying the flow direction of the refrigerant flowing through the outdoor heat exchanger 2, the indoor units (C1, C2 and C3) can selectively heat or cool the room airs.

Figure 2A:
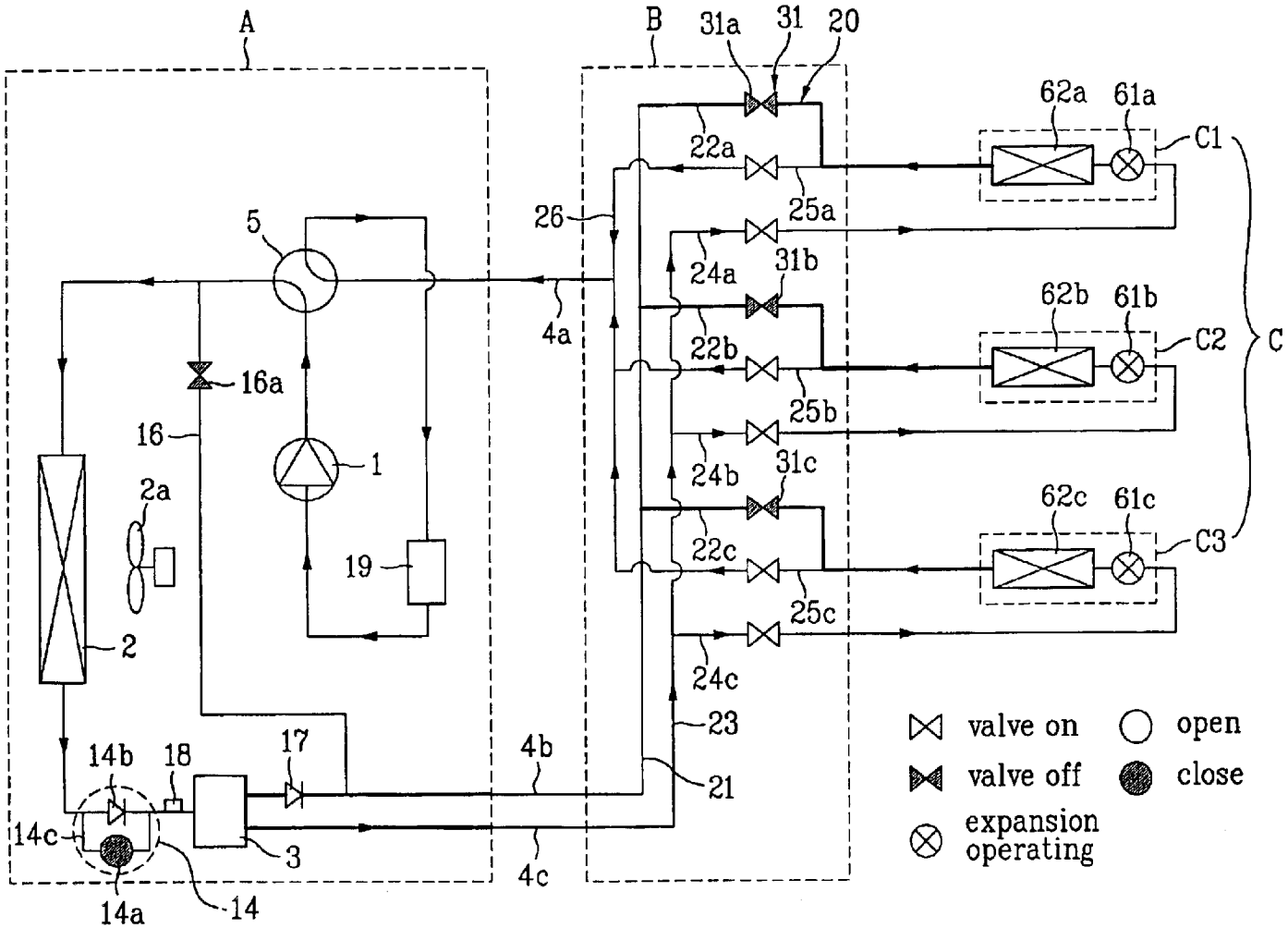
FIG. 2A is a view illustrating an operation state of FIG. 1 in case all indoor units operate in a cooling mode.

Referring to FIG. 2A, the four-way valve 5 is switched to connect the discharging outlet of the compressor 1 with the outdoor heat exchanger 2 and to connect the absorbing inlet of the compressor 1 with the distributor (B). At this time, the outdoor heat exchanger 2 functions as the condenser to allow the indoor unit (C) to cool the room airs.

Figure 2B:
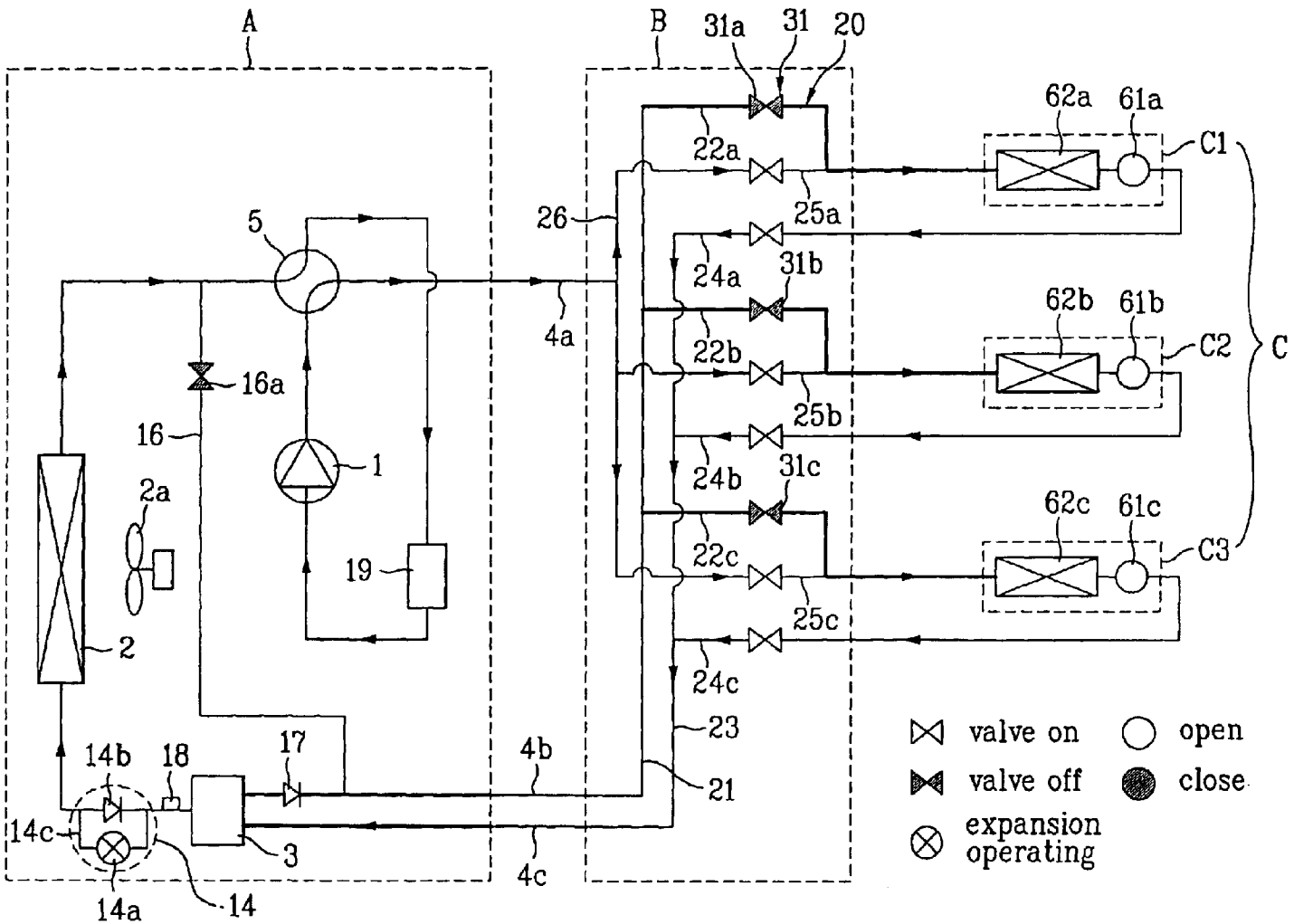
FIG. 2B is a view illustrating an operation state of FIG. 1 in case all indoor units operate in a heating mode.

Meanwhile, referring to FIG. 2B, the four-way valve 5 is switched to connect the discharging outlet of the compressor 1 with the distributor (B) and to connect the absorbing inlet of the compressor 1 with the outdoor heat exchanger 2. At this time, the outdoor heat exchanger 2 functions as the evaporator to allow the indoor unit (C) to heat the room airs.

As shown in FIGS. 2A and 2B, as the four-way valve 5 is switched to vary a tube-connecting state between respective structural elements in the outdoor unit (A), the flow direction of the refrigerant flowing through the outdoor heat exchanger 2 is varied.

As shown in FIG. 1, three tubes are provided for flowing the refrigerant between the outdoor unit (A) and the distributor (B).

A first connection tube 4*a* functions to connect the four-way valve 5 with the distributor (B). A second connection tube 4*b* functions to connect an upper portion of the gas-liquid separator 3 with the distributor (B) to guide the vapor-phase refrigerant. And, a third connection tube 4*c* functions to connect a lower portion of the gas-liquid separator 3 with the distributor (B) to guide the liquid-phase refrigerant.

On the other hand, in case a majority of indoor units (C) operates in the heating mode while the rest thereof operates in the cooling mode, a bypass unit is preferably provided. The bypass unit allows the refrigerant introduced into the outdoor unit (A) through the second connection tube 4*b*, to be guided to the absorbing inlet of the compressor 1 not via the outdoor heat exchanger 2 and the gas-liquid separator 3.

As shown in FIG. 1, the bypass unit is comprised of a bypass tube 16, a first valve 16*a* and a second check valve 17.

Herein, the bypass tube 16 functions to connect the second connection tube 4*b* with a connection tube between the four-way valve 5 and the outdoor heat exchanger 2.

The first valve 16*a* is provided in the bypass tube 16 to be opened only in case the majority of the indoor units (C) operate in the cooling mode while the rest thereof operates in the heating mode.

The second check valve 17 is provided in the second connection tube 4*b* positioned between the gas-liquid separator 3 and the bypass tube 16, to allow only refrigerant flowing from the gas-liquid separator 3 to the distributor (B) to pass therethrough.

Also, the multi-air conditioner according to the present invention preferably further includes a controller for controlling revolution times of the outdoor fan 2*a* such that a mixed ratio of the vapor-phase refrigerant and the liquid-phase refrigerant introduced into the gas-liquid separator 3 via the outdoor heat exchanger 2 is controlled depending on an operation condition.

The controller is comprised of a temperature sensor 18 and a microcomputer (not shown).

Herein, the temperature sensor 18 is provided between the outdoor heat exchanger 2 and the gas-liquid separator 3, to sense a temperature of the refrigerant. The microcomputer compares the sensed temperature of the refrigerant with a predetermined temperature to calculate the mixed ratio of the refrigerant in the tube, and controls the revolution times of the outdoor fan 2*a* to equalize the calculated mixed ratio with the predetermined mixed ratio depending on the operation condition. The revolution times of the outdoor fan 2*a* is controlled so as to supply an optimal refrigerant, in both cases the indoor units operate in the cooling mode, and the majority of the indoor units operates in the cooling mode while the rest operates in the heating mode.

Hereinafter, a construction of the distributor (B) will be described in detail.

As shown in FIG. 1, the distributor (B) is comprised of the guide tube part 20 and the valve part 31. The guide tube part 20 guides the refrigerant introduced from the outdoor unit (A) to the respective indoor units (C), and inversely guides the refrigerant heat-exchanged in the indoor units (C) to the outdoor unit (A). The valve part 31 controls a flow of the refrigerant in the guide tube part 20 such that the refrigerant selectively flows into each indoor unit (C) depending on the operation condition.

Herein, the guide tube part 20 is comprised of vapor-phase branch tubes 22, liquid-phase branch tubes 24, and connection branch tubes 25.

The vapor-phase branch tubes 22 are branched from the second connection tube 4*b* to be connected to the respective indoor units (C), thereby guiding the vapor-phase refrigerant. The liquid-phase branch tubes 24 are branched from the third connection tube 4*c* to be connected to the respective indoor unit (C), thereby guiding the liquid-phase refrigerant. The connection branch tubes 25 function to connect the first connection tube 4*a* with the respective indoor units (C).

Meanwhile, the valve part 31 is comprised of a two-way valve being respectively provided for the vapor-phase branch tube 22, the liquid-phase branch tube 24, and the connection branch tube 25. The two-way valves are selectively respectively switched depending on the operation condition.

Hereinafter, a construction of the indoor unit (C) will be described in detail.

As shown in FIG. 1, the indoor unit (C) is each comprised of an indoor heat exchanger 62, an electronic expansion valve 61, and an indoor fan (not shown) for ventilating the indoor heat exchanger 62.

Hereinafter, an exemplary operation and a flow of the refrigerant in the multi-air conditioner according to a preferred embodiment of the present invention will be given with reference to FIGS. 2A to 3B.

As shown in the drawings, the multi-air conditioner provides three indoor units (C), but is not limited to that, and more indoor units can be provided if necessary.

As shown in FIG. 2A, descriptions will be in detail made for the case all indoor units (C) operate in the cooling mode.

The refrigerant discharged from the compressor 1 is introduced into the outdoor heat exchanger 2 by the switching operation of the four-way valve 5. After that, the introduced refrigerant is cooled by ventilation of the outdoor fan 2*a* under the control of the controller.

Next, the cooled refrigerant passes through the first check valve 14*b* of the selective expansion unit 14 and is introduced into the gas-liquid separator 3.

At this time, the revolution times of the outdoor fan 2*a* is controlled to condense all refrigerant introduced into the outdoor heat exchanger 2 such that all refrigerant introduced into the gas-liquid separator 3 becomes in a liquid phase.

After that, the high-pressure and liquid-phase refrigerant passes through the third connection tube 4*c* and the liquid-phase tube 23 and is branched into the respective liquid-phase branch tubes 24. Next, after the branched refrigerant is expanded in the electronic expansion valve 61, the expanded refrigerant is evaporated in the indoor heat exchanger 62 to cool the room airs.

The evaporated refrigerant is converged into one return tube 26 along each connection branch tube 25 and is then introduced into the first connection tube 4*a*. At this time, each vapor-phase branch tube 22 is closed. After that, the refrigerant passes through the four-way valve 5 and an accumulator 19 to be absorbed in the compressor 1.

As shown in FIG. 2B, descriptions will be made in detail for the case the indoor units (C) all operate in the heating mode.

The refrigerant discharged from the compressor 1 is introduced into the first connection tube 4*a* in a high pressure by the switching operation of the four-way valve 5. After that, the refrigerant passes through the return tube 26 and is branched into the connection branch tubes 25 respectively.

Next, the high-pressure and vapor-phase refrigerant passes through the indoor heat exchanger 62 respectively and is condensed with heating the room airs.

The condensed refrigerant passes through the opened electronic expansion valve 61, the liquid-phase branch tube 24, and the liquid-phase tube 23 and is introduced into the third connection tube 4*c*. At this time, the two-way valves 31 provided in the vapor-phase branch tube 22 are closed.

After that, the introduced refrigerant passes through the gas-liquid separator 3 and expands in the heating electronic expansion valve 14*a* of the selective expansion unit 14. Next, the expanded refrigerant is introduced into the outdoor heat exchanger 2 and is vaporized to be changed into a low-pressure and vapor-phase refrigerant. The low-pressure and vapor-phase refrigerant passes through the four-way valve 5 and the accumulator 19 and is introduced into the compressor 1.

Figure 3A:
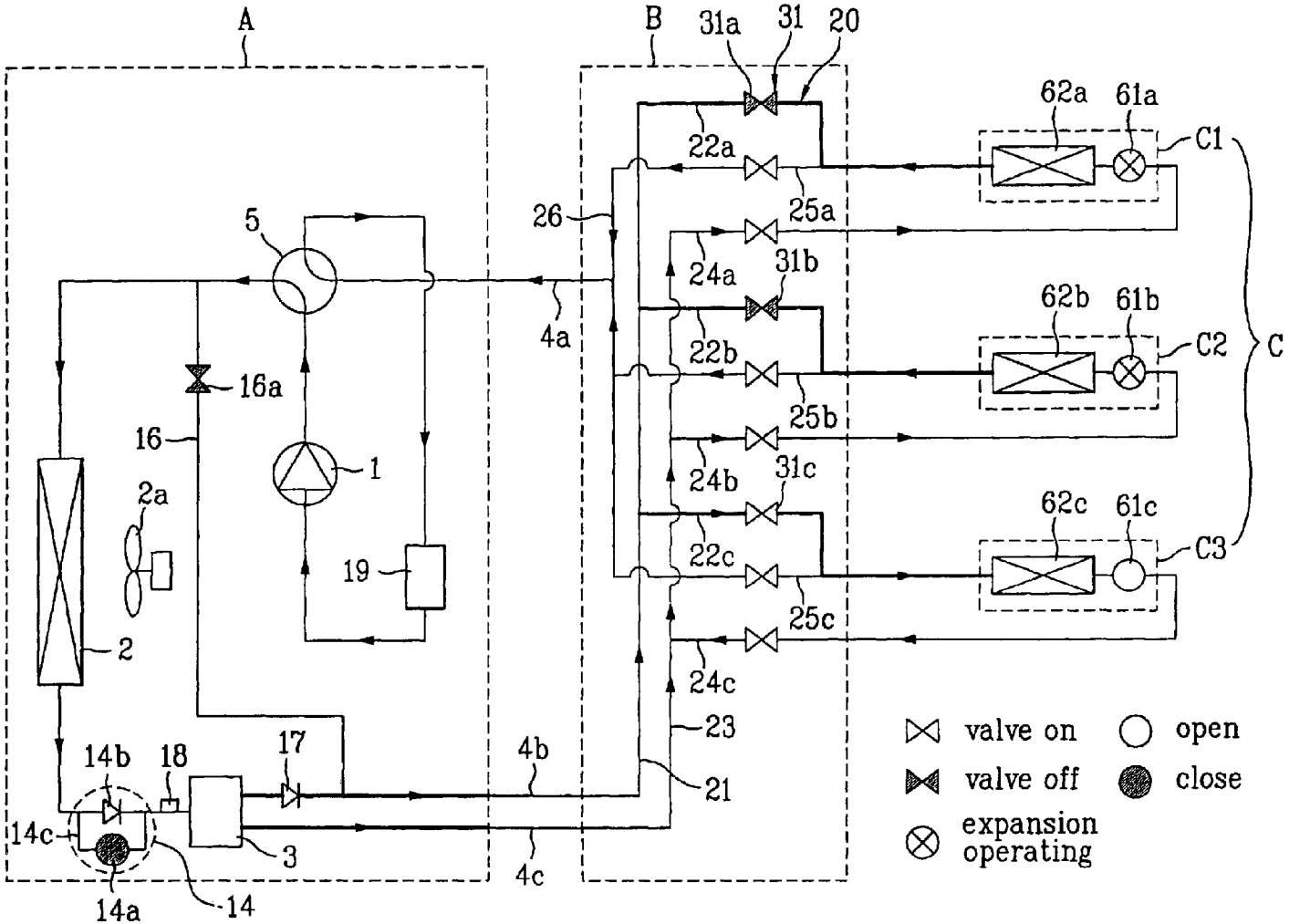
FIG. 3A is a view of illustrating an operation state of FIG. 1 in case a majority of indoor units operate in a cooling mode while the rest of them operates in a heating mode.

As shown in FIG. 3A, descriptions will be made in detail for the case the majority of indoor units (C1, C2) operate in the cooling mode while the rest (C3) operates in the heating mode.

The refrigerant discharged from the compressor 1 is introduced into the outdoor heat exchanger 2 by the switching operation of the four-way valve 5. After the introduced refrigerant becomes in an optimal two-phase (vapor and liquid phases) state by the ventilation of the outdoor fan 2*a* under the control of the controller, the two-phase refrigerant passes through the first check valve 14*b* and is introduced into the gas-liquid separator 3.

At this time, the mixed ratio of the two-phase refrigerant introduced into the gas-liquid separator 3 is optimized by the controller. That is, the temperature sensor measures a temperature of the refrigerant, and then the microcomputer compares the measured temperature with the predetermined temperature to calculate the mixed ratio of the refrigerant. The mixed ratio of the refrigerant is optimized, by controlling the revolution times of the outdoor fan 2*a* to equalize the calculated mixed ratio with the predetermined mixed ratio.

Herein, the predetermined mixed ratio of the two-phase refrigerant is determined, according to the number of the indoor units (C1, C2) operating in the cooling mode using the liquid-phase refrigerant and to the number of the outdoor unit (C3) operating in the heating mode using the vapor-phase refrigerant. More specifically, the predetermined mixed ratio of the two-phase refrigerant is an experimental value which is determined by an experiment considering the flow and various loads of the condensed refrigerant passing through the indoor units (C1, C2) operating in the cooling mode and introduced into the indoor unit (C3) operating in the heating mode.

The liquid-phase refrigerant of the high-pressure and two-phase refrigerant sequentially passes through the third connection tube 4*c*, the liquid-phase tube 23 and the liquid-phase branch tubes 24*a* and 24*b*, to be introduced into the indoor units (C1, C2) operating in the cooling mode.

After that, the introduced refrigerant is expanded in the respective electronic expansion valves 61*a* and 61*b* and is evaporated in each of the indoor heat exchangers 62*a* and 62*b*, to cool the room airs.

On the other hand, the vapor-phase refrigerant sequentially passes through the second connection tube 4*b*, the vapor-phase tube 21 and the vapor-phase branch tube 22*c*, to be introduced into the indoor unit (C3) operating in the heating mode. After the introduced refrigerant is condensed in the indoor heat exchanger 62*c* to heat the room air, the condensed refrigerant passes through the opened electronic expansion valve 61*c* and the liquid-phase branch tube 24*c* to be introduced into the liquid-phase tube 23. Accordingly, the condensed refrigerant is introduced into the indoor units (C1, C2) operating in the cooling mode along with the above described liquid-phase refrigerant.

Herein, since a pressure of the refrigerant flowing through the liquid-phase branch tube 24*c* connected to the indoor unit (C3) operating in the heating mode is higher than a pressure of the refrigerant flowing through the liquid-phase tube 23, the refrigerant is introduced into the liquid-phase tube 23 without reverse current.

After that, the refrigerant evaporated with passing through the indoor units (C1, C2) needing to be cooled passes through the connection branch tubes 25*a* and 25*b* and the return tube 26 to be introduced into the first connection tube 4*a*, and then passes through the four-way valve 5 and the accumulator 19 to be absorbed in the compressor 1.

Figure 3B:
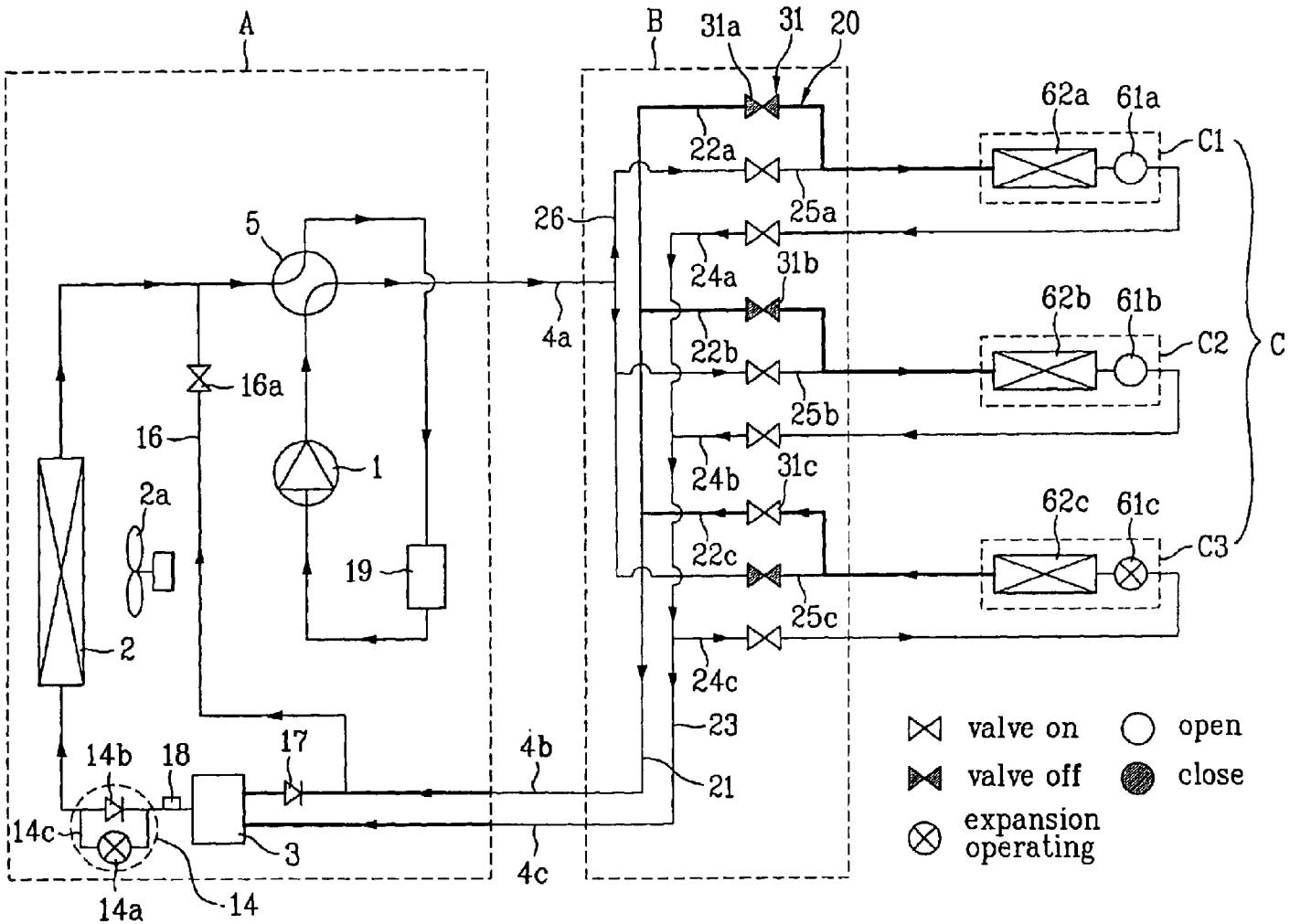
FIG. 3B is a view of illustrating an operation state of FIG. 1 in case a majority of indoor units operates in a heating mode while the rest thereof operates in a cooling mode.

As shown in FIG. 3B, descriptions will be made in detail for the case the majority of indoor units operate in the heating mode while the rest operates in the cooling mode.

The refrigerant discharged from the compressor 1 passes through the first connection tube 4*a* by the switching operation of the four-way valve 5 to be introduced into the return tube 26 of the distributor (B). After that, the introduced refrigerant passes through the connection branch tubes 25*a* and 25*b* connected to the indoor units (C1, C2) operating in the heating mode, to be introduced into the indoor heat exchangers 62*a* and 62*b*. The introduced high-pressure and vapor-phase refrigerant is condensed in the indoor heat exchangers 62*a* and 62*b* to heat the room air.

Next, the condensed refrigerant passes through the opened electronic expansion valves 61*a* and 61*b*, the liquid-phase branch tubes 24*a* and 24*b* and the liquid-phase tube 23. After that, a portion of the condensed refrigerant is introduced into the third connection tube 4*c*, while the remaining portion of the condensed refrigerant is introduced into the liquid-phase branch tube 24*c* connected to the indoor unit (C3) operating in the cooling mode.

After that, the refrigerant introduced into the third connection tube 4*c* passes through the gas-liquid separator 3 to expand in the heating electronic expansion valve 14*a* of the selective expansion unit 14. Afterwards, after the expanded refrigerant passes through the outdoor heat exchanger 2 to be evaporated, the evaporated refrigerant passes through the four-way valve 5 and the accumulator 19 to be absorbed in the compressor 1.

In the meanwhile, after the remaining portion of the condensed refrigerant is introduced into the liquid-phase branch tube 24*c* connected to the indoor unit (C3) operating in the cooling mode, the introduced refrigerant passes through the electronic expansion valve 61*c* to be expanded. The expanded refrigerant is evaporated in the indoor heat exchanger 62*c* to cool the room air.

After that, the evaporated refrigerant sequentially passes through the vapor-phase branch tube 22*c*, the vapor-phase tube 21 and the second connection tube 4*b* to be introduced into the bypass tube 16. At this time, introduced of the refrigerant into the second check valve l7 is closed.

Next, the refrigerant passes through the opened first valve 16*a* to be introduced into the four-way valve 5. After that, the refrigerant passes through the accumulator 19 to be absorbed in the compressor 1.

Herein, since the pressure of the refrigerant passing through the liquid-phase branch tubes 24*a* and 24*b* connected to the indoor units (C1, C2) operating in the heating mode is higher than the pressure of the refrigerant passing through the liquid-phase branch tube 24*c* connected to the indoor unit (C3) operating in the cooling mode, the refrigerant can be introduced into the indoor unit (C3) operating in the cooling mode.

On the other hand, described will be an operation method of the multi-air conditioner according to the present invention in both cases the indoor units (C) all operate in the cooling mode, or the majority of indoor units (C1, C2) operate in the cooling mode while the rest (C3) operates in the heating mode.

First, the temperature sensor 18 measures the temperature of the refrigerant. After that, the microcomputer compares the measured temperature of the refrigerant with the predetermined temperature to calculate the mixed ratio of the refrigerant passing through the outdoor heat exchanger 2. The optimal mixed ratio is maintained, by controlling the revolution times of the outdoor fan 2*a* to equalize the calculated mixed ratio with the predetermined mixed ratio.

As described previously, the multi-air conditioner according to the present invention can respond to the environment of each room optimally. That is, the multi-air conditioner can operate in the heating mode or the cooling mode so as to heat or cool all rooms, and also enables operation in a mode in which some rooms operate in the cooling mode and the others operates in the heating mode. Further, in the latter case, the multi-air conditioner can respond optimally depending on whether the majority of the rooms operate in the cooling mode or in the heating mode.

In other words, the multi-air conditioner and an operation method thereof according to the present invention have advantages as follows.

First, an optimal adaptation for environments of respective rooms can be accomplished. In other words, an optimal adaptation can be accomplished for environments of the computer center needing to be cooled in summer days and even in winter days as well as a plurality of rooms having a temperature difference depending on the positions or time of the rooms.

Second, since the gas-liquid separator having a relatively large weight and volume is installed in the outdoor unit, not in the distributor, the weight of the distributor is reduced, so that easy installation of the distributor is possible.

Third, the tube structure and construction of the outdoor unit are simplified to reduce a pressure loss or the like of the tube, thereby improving the efficiency of the multi-air conditioner. Also, the fabrication process can be simplified and the product price can be lowered.

Fourth, in case the indoor units all operate in the cooling mode, or in case the majority of the indoor units operates in the cooling mode while the rest operates in the heating mode, the mixed ratio of the refrigerant can be optimized to improve the efficiency of air conditioning.

It will be apparent to those skilled in the art that various modifications and variations can be made in the present invention. For example, the noise suppressing apparatus may be installed at the refrigerant tube of the outdoor unit, as well as the indoor unit. Also, a number of comparting plates are not integrally formed with the body, but is separately inserted and fixed to the body. Thus, it is intended that the present invention covers the modifications and variations of this invention provided they come within the scope of the appended claims and their equivalents.

What is claimed is:

1. A multi-air conditioner comprising:

an outdoor unit installed at an outdoor location, and having a compressor, an outdoor heat exchanger, and an outdoor fan for ventilating the outdoor heat exchanger;

a plurality of indoor units installed at respective indoor areas, each indoor unit having an electronic expansion valve and an indoor heat exchanger;

a distributor provided between the outdoor unit and the plurality of indoor units, for selectively guiding a refrigerant from the outdoor unit to the plurality of indoor units according to an operation condition;

a four-way valve provided on an outlet side of the compressor, for selectively switching a flow direction of the refrigerant flowing through the outdoor heat exchanger;

a selective expansion unit provided at a side of the outdoor heat exchanger, for selectively expanding the refrigerant according to a flow direction of the refrigerant;

a gas-liquid separator provided in the outdoor unit, for separating a vapor-phase refrigerant and a liquid-phase refrigerant from the refrigerant flowing out of the outdoor heat exchanger; and a connection tube part having a first connection tube for connecting the four-way valve with the distributor, a second connection tube for connecting an upper portion of the gas-liquid separator with the distributor to guide the vapor-phase refrigerant, and a third connection tube for connecting a lower portion of the gas-liquid separator with the distributor to guide the liquid-phase refrigerant.

2. The multi-air conditioner of claim 1, wherein the four-way valve selectively switches between a first connection state in which the outlet side of the compressor is connected with the outdoor heat exchanger and an inlet side of the compressor is connected with the distributor, and a second connection state in which the outlet side of the compressor is connected with the distributor and the inlet side of the compressor is connected with the outdoor heat exchanger.

3. The multi-air conditioner of claim 1, wherein the selective expansion unit comprises:

parallel tubes extending between the outdoor heat exchanger and the gas-liquid separator;

a first check valve provided along one of the parallel tubes, for passing the refrigerant flowing from the outdoor heat exchanger toward the gas-liquid separator; and a heating electronic expansion valve provided on the other of the parallel tubes, for expanding the refrigerant introduced into the outdoor heat exchanger.

4. The multi-air conditioner of claim 1, further comprising a bypass unit for guiding the refrigerant introduced through the second connection tube to the inlet of the compressor, when a majority of indoor units operate in a heating mode while the remaining indoor units operate in a cooling mode.

5. The multi-air conditioner of claim 4, wherein the bypass unit comprises:

a bypass tube for connecting the first connection tube with a tube connecting the four-way valve and the outdoor heat exchanger;

a first valve provided on the bypass tube, and opened only when the majority of indoor units operate in the cooling mode while the remaining indoor units operate in the heating mode; and a second check valve provided on the second connection tube and positioned between the gas-liquid separator and the bypass tube, for passing only the refrigerant flowing from the gas-liquid separator toward the distributor.

6. The multi-air conditioner of claim 5, wherein the distributor comprises:

a guide tube for selectively guiding the refrigerant from the outdoor unit to the respective indoor units, and guiding the refrigerant heat-exchanged in the respective indoor units to the outdoor unit; and a valve for controlling a flow of the refrigerant in the guide tube such that the refrigerant is selectively introduced into the respective indoor unit according to the operation condition.

7. The multi-air conditioner of claim 6, wherein the guide tube comprises:

vapor-phase branch tubes branched from the second connection tube and connected to the indoor units, respectively;

liquid-phase branch tube branched from the third connection tube and connected to the indoor units, respectively; and connection branch tubes connecting the first connection tube and the indoor units, respectively.

8. The multi-air conditioner of claim 7, wherein the valve comprises a two-way valve provided in each of the vapor-phase branch tubes, each of the liquid-phase branch tubes, and each of the connection branch tubes, and turned on or off according to the operation condition.

9. The multi-air conditioner of claim 8, wherein the electronic expansion valve of each of the indoor units is provided in each of the liquid-phase branch tubes connecting the indoor heat exchangers and the distributor.

10. The multi-air conditioner of claim 9, wherein, when the indoor units all operate in the cooling mode or when the majority of indoor units operate in the cooling mode while the remaining indoor units operate in the heating mode, the four-way valve is switched to connect an outlet of the compressor with the outdoor heat exchanger and to connect an inlet of the compressor with the distributor.

11. The multi-air conditioner of claim 10, wherein, when the indoor units all operate in the cooling mode, the heating electronic expansion valve and the first valve are closed, the electronic expansion valves of the indoor units all operate, the two-way valves connected to the vapor-phase branch tubes are all closed, and the two-way valves connected to the connection branch tubes and the liquid-phase branch tubes are all opened.

12. The multi-air conditioner of claim 10, wherein, when the majority of indoor units operate in the cooling mode while the remaining indoor units operate in the heating mode, the heating electronic expansion valve and the first valve are closed, for the indoor units that operate in the cooling mode, the electronic expansion valve connected to the indoor heat exchangers operate, the two-way valves connected to the vapor-phase branch tubes are closed, and the two-way valves connected to the connection branch tubes and to the liquid-phase branch tubes are opened, and for the indoor units that operate in the heating mode, the electronic expansion valves connected to the indoor heat exchangers are opened, and the two-way valves connected to the vapor-phase branch tubes, to the liquid-phase branch tubes and to the connection branch tubes are opened.

13. The multi-air conditioner of claim 9, wherein, when the indoor units all operate in the heating mode, or when the majority of indoor units operate in the heating mode while the remaining indoor units operate in the cooling mode, the four-way valve is switched to connect the outlet of the compressor with the distributor and to connect the inlet of the compressor with the outdoor heat exchanger.

14. The multi-air conditioner of claim 13, wherein, when the indoor units all operate in the heating mode, the heating electronic expansion valve operates, the first valve is closed, the electronic expansion valves of the indoor units are all opened, the two-way valves connected to the vapor-phase branch tubes are all closed, and the two-way valves connected to the connection branch tubes and to the liquid-phase branch tubes are all opened.

15. The multi-air conditioner of claim 13, wherein, when the majority of indoor units operate in the heating mode while the remaining indoor units operate in the cooling mode, the heating electronic expansion valve operates and the first valve is closed, for the indoor units that operate in the heating mode, the electronic expansion valves connected to the indoor heat exchangers are opened, the two-way valves connected to the vapor-phase branch tubes are closed, and the two-way valves connected to the connection branch tubes and to the liquid-phase branch tubes are opened, and for the indoor units that operate in the cooling mode, the electronic expansion valves connected to the indoor heat exchangers operate, the two-way valves connected to the vapor-phase branch tube and to the liquid-phase branch tube are closed, and the two-way valves connected to the connection branch tube are opened.

16. The multi-air conditioner of claim 1, further comprising a controller that controls revolution times of the outdoor fan such that a mixed ratio of a vapor-phase refrigerant and a liquid-phase refrigerant introduced to the gas-liquid separator via the outdoor heat exchanger is controlled according to the operation condition.

17. The multi-air conditioner of claim 16, wherein the controller comprises:

a temperature sensor provided between the outdoor heat exchanger and the gas-liquid separator, for sensing a temperature of the refrigerant; and a microcomputer for comparing the sensed temperature of the refrigerant with a predetermined temperature to calculate the mixed ratio of the refrigerant, and for controlling the revolution times of the outdoor fan to equalize the calculated mixed ratio with a predetermined mixed ratio according to the operation condition, when the indoor units all operate in the cooling mode, or when a majority of indoor units operate in the cooling mode while the remaining indoor units operate in the heating mode.

18. The multi-air conditioner of claim 1, wherein the gas-liquid separator is provided between the selective expansion unit and the distributor.

19. An operation method of a multi-air conditioner, the method comprising:

when indoor units all operate in a cooling mode, or when a majority of indoor units operate in the cooling mode while the remaining indoor units operate in a heating mode, switching a four-way valve such that a refrigerant discharged from a compressor is introduced into an outdoor heat exchanger; and closing a heating electronic expansion valve, and when the indoor units all operate in the heating mode, or when the majority of indoor units operate in the heating mode while the remaining indoor units operate in the cooling mode, switching the four-way valve such that a vapor-phase refrigerant discharged from the compressor is introduced into a connection tube; and operating the heating electronic expansion valve.

20. An operation method of a multi-air conditioner, the method comprising:

when indoor units all operate in a cooling mode, or when a majority of indoor units operate in the cooling mode while the remaining indoor units operate in a heating mode, sensing a temperature of a refrigerant flowing between an outdoor heat exchanger and a gas-liquid separator using a temperature sensor;

comparing the sensed temperature of the refrigerant with a predetermined temperature to detect a mixed ratio of the refrigerant in a tube; and varying revolution times of an outdoor fan to equalize the detected mixed ratio with a predetermined mixed ratio.

* * * * *